United States Patent [19]

Summerauer et al.

[11] Patent Number: 4,863,112

[45] Date of Patent: Sep. 5, 1989

[54] METHOD FOR STORING COILS OF WOUND BAND-LIKE BLANK MATERIAL AND FOR CHARGING A PROCESSING MACHINE, AND AN INSTALLATION FOR THIS PURPOSE

[75] Inventors: Ingomar J. K. Summerauer; Oskar Eigenmann, both c/o Frasnacht, Switzerland

[73] Assignee: Bruderer AG, Switzerland

[21] Appl. No.: 39,533

[22] Filed: Apr. 16, 1987

[30] Foreign Application Priority Data

Apr. 18, 1986 [CH] Switzerland ..... 01574/86-2
Nov. 5, 1986 [CH] Switzerland ..... 04405/86-5

[51] Int. Cl.[4] ..... B65H 20/00; B65G 1/02

[52] U.S. Cl. ..... 242/78.8; 242/79; 414/618

[58] Field of Search ..... 242/78, 78.6, 78.8, 242/79, 80, 81, 58.6; 414/268, 618, 624, 683

[56] References Cited

U.S. PATENT DOCUMENTS 3,233,751 2/1966 Bannon ..... 414/618
3,363,929 1/1968 Nelson ..... 414/619
3,411,723 11/1968 Hall ..... 242/55
4,290,563 9/1981 Brooks et al. ..... 242/78.6
4,614,474 9/1986 Sudo ..... 414/618 X

FOREIGN PATENT DOCUMENTS 166895 1/1986 European Pat. Off. .
2222151 10/1974 France .
2340149 2/1977 France .
627955 2/1982 Switzerland .
2167047 5/1986 United Kingdom .

*Primary Examiner*—Stuart S. Levy
*Assistant Examiner*—Stephen M. duBois
*Attorney, Agent, or Firm*—Ostrolenk, Faber, Gerb & Soffen

[57] ABSTRACT

Coils (C) containing band-like blank material are stored in a magazine station (M) in a horizontal position, i.e. with the axis vertical. They rest on a level underlay, together with which they can be gripped, still in the horizontal position, and fed to an unwinding station (H), where, together with the underlay, they can be placed horizontally and unwound, in order to feed the band-like blank material to a processing station (B).

62 Claims, 13 Drawing Sheets

METHOD FOR STORING COILS OF WOUND BAND-LIKE BLANK MATERIAL AND FOR CHARGING A PROCESSING MACHINE, AND AN INSTALLATION FOR THIS PURPOSE

BACKGROUND OF THE INVENTION

The invention relates to a method for storing coils of wound band-like blank material and for charging a processing machine with said coils.

A method of this type is essentially described in EP-A-0 166 895. In this method, the coils (this name is used for rolls of steel or nonferrous metal bands) are stored in a horizontal position, i.e. with a vertical winding axis, in cassettes which contain supporting rolls for the coil. For processing, the cassettes are removed from the magazine and hoisted on a winch which has a horizontal axis and which requires an expanding means in order to hold the coil under tension from inside.

This EP-A-0 166 895 is primarily concerned with obtaining an ordered store so that any desired coil can be found rapidly at any time and fed to the unwinding station. Systems having roll arrangements in cassettes similar to that according to EP-A-0 166 895 which are used at the unwinding station have already been launched on the market. However, none of these roll arrangements ensures an even underlay for the coil, so that the known proposals all have handling and/or design disadvantages to which far too little attention has been paid so far with regard to optimizing the procedure. Because of the unstable support of the coil, the latter tends to collapse, in particular when it only has a few turns. If it is to be returned to the magazine, the individual windings have to be tied up at several points in order to prevent the band from becoming entangled. For the same reason, however, the expandable winch, which is expensive to construct and is also known from the textile industry for handling hanks, is also required, but in this case must be of much more massive construction so that the unstable coil does not fall apart, particularly in the vertical position, i.e. when the axis is horizontal. Nevertheless, this cannot be completely avoided in the case of the known proposals, which may lead to spoilage owing to distortion of the material. To date, all these disadvantages have been accepted as unavoidable.

SUMMARY OF THE INVENTION

The object of the invention is to simplify these processes and make them more reliable; this is achieved, according to the invention, by a combination of the following steps:

(a) the coils are stored in a magazine on a horizontal underlay with the coil axis at right angles, (b) the coils, still in the horizontal position with the coil axis at right angles, on their underlay, are brought to an unwinding station, and (c) in the unwinding station, the band-like blank material is taken off from the coil while keeping the latter in the horizontal position and is fed to the processing machine after being rotated through 90 degrees. According to a further aspect of the method, the coil is unwound from its outer circumference in the unwinding station.

Because the coil is always held horizontal and is always supported by a horizontal underlay, handling is, surprisingly, greatly simplified and results in the following particular advantages in the work sequence and in construction:

the operation of tying the coil can be dispensed with, an expandable winch is no longer necessary, the coils, which are constantly kept in a horizontal position, with a horizontal underlay, no longer tend to collapse, so that there is no longer any need to untangle such coils, and furthermore there are therefore no one-sided internal stresses in the band-like blank material which may result in spoilage.

An installation for carrying out this method is based on an installation having a magazine station in which the coil can be stored in the horizontal position with the coil axis at right angles, and an unwinding station in which a coil support is provided, from which unwinding station the band-like blank material wound on the coil can be fed to a processing station. It is characterized by the fact that the coil support is likewise designed for a horizontal position of the coil with the coil axis at right angles, and an essentially level respective underlay is provided for supporting the coils in all stations, on which underlay the coil can be brought from the horizontal position in the magazine station to the horizontal coil support.

BRIEF DESCRIPTION OF THE DRAWINGS

Further details are given in the following description of embodiments of the invention, and shown schematically in the drawings in which:

FIG. 4 shows another embodiment in a representation similar to FIG. 1, of which

FIGS. 6*a* to 6*c* show different stages during laying of a coil on a particular embodiment of a coil support in the unwinding station, which FIG. 7 shows in plan view, whereas

FIG. 10 shows a plan view of another installation having a modified magazine station and a process control system, of which

DETAILED DESCRIPTION OF THE EMBODIMENTS

Figure 1:
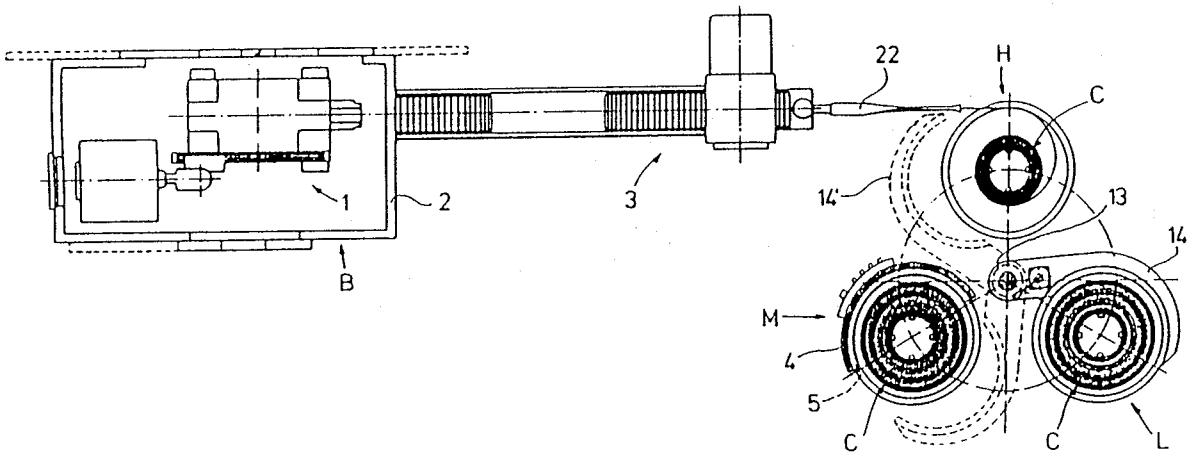
FIG. 1 shows a plan view of an installation used to illustrate the method.
Figure 2:
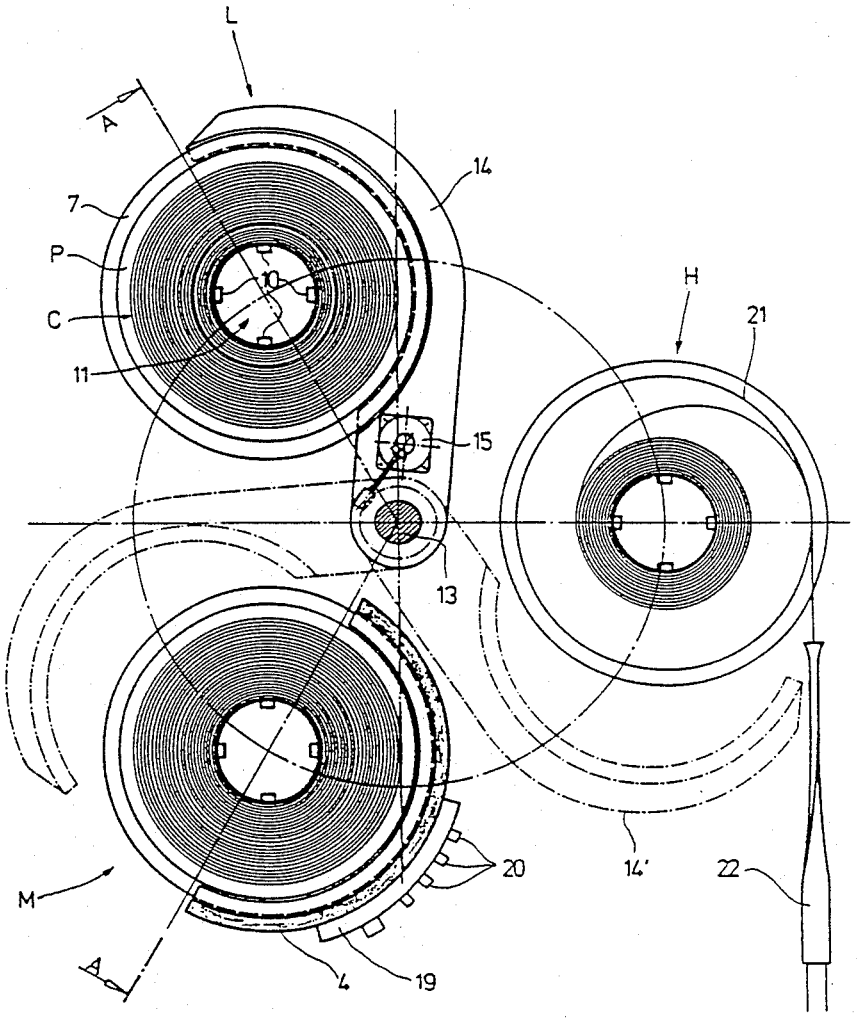
FIG. 2 shows a portion of FIG. 1 on a larger scale.
Figure 3:
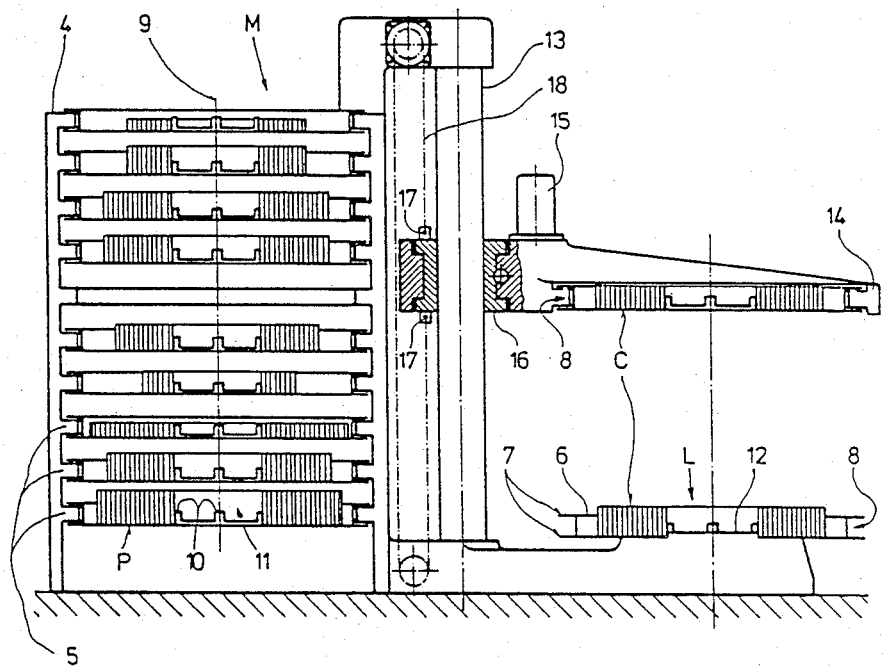
FIG. 3 shows a cross section taken along the line A—A of FIG. 2.

In the embodiment according to FIGS. 1 to 3, a magazine station M, a winch or unwinding station H and a processing station B are provided in an installation, which processing station can be designed for various processing operations, for example for welding band-like blank material, but preferably for punching. Thus, in processing station B, a punch press 1 is shown schematically in plan view inside a sound-insulating housing 2, as required for high-speed punch presses.

Figures 9, 9A:
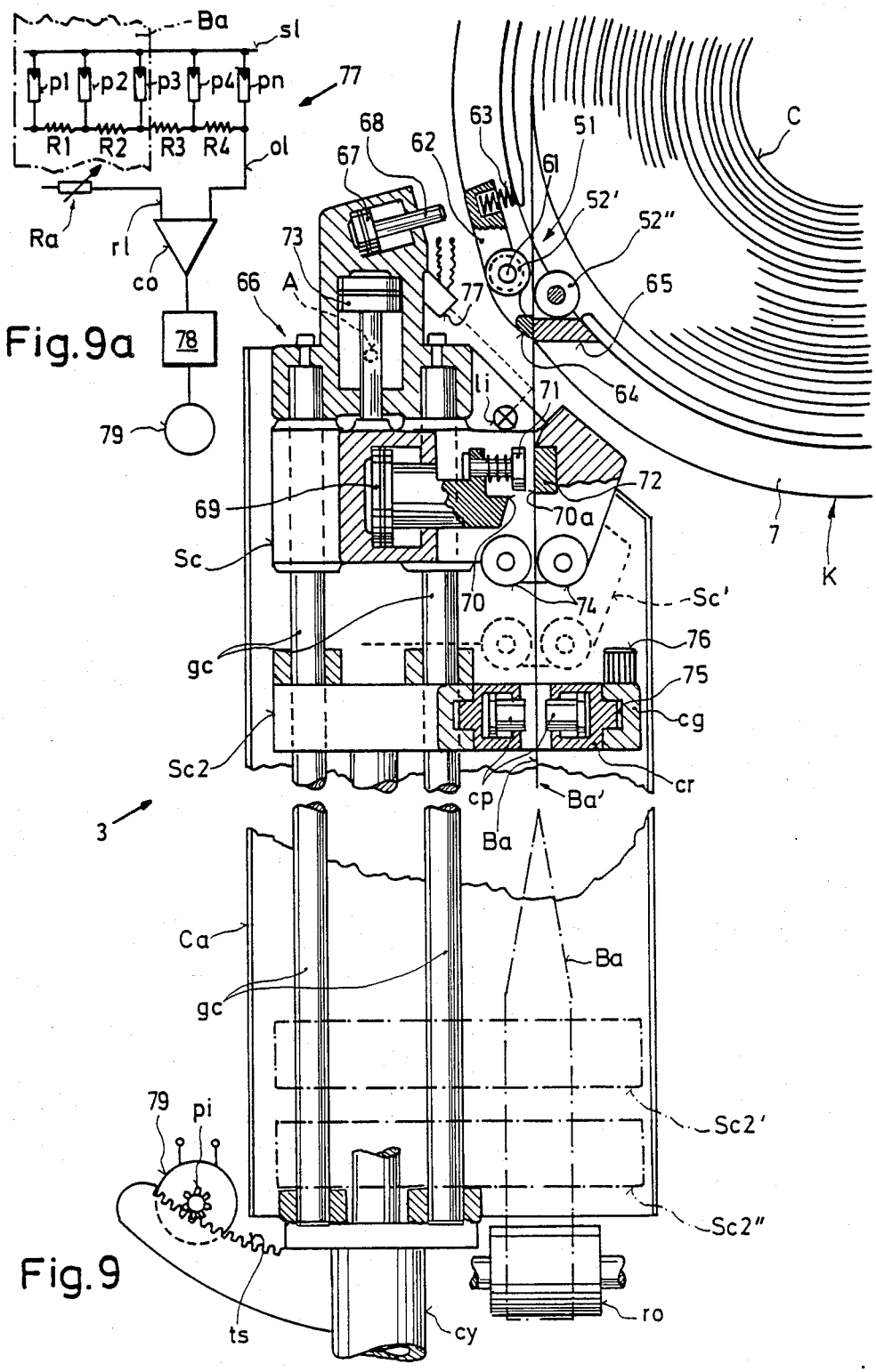
FIGS. 9 and 9*a* show an associated take-off means.

In the unwinding station H, band-like blank material of steel or nonferrous metal wound to form coils C is pulled off, with the aid of a take-off means 3 which is merely indicated schematically and may or may not be known per se, from the particular coil C present at the unwinding station H, and is fed to the punch press 1. Details of a preferred embodiment of this take-off means 3 are shown in FIG. 9.

As shown particularly clearly in FIGS. 2 and 3, the magazine station M has a semicylindrical stand 4 which is provided inside with semicircular ribs 5 at intervals which are preferably uniform. Each of the coils C housed therein rests on a disk-shaped plate P which possesses, at its periphery, a raised border 6 which surrounds the coil over at least part of its height. This border 6 is provided at each end with a projecting flange 7, a depression 8 being defined between the flanges 7.

Although the disk-shaped underlay is essentially flat (slight ribbing would cause no harm), it possesses, in the central region, retaining tabs 10 which extend parallel to the coil axis 9 and are produced, for example, by punching out the central orifice 11 and bending over the tabs 10. These retaining tabs 10 (which, like the flanges 7, may be in the form of a continuous retaining surface, although this would be more disadvantageous in terms of manufacture; conversely, individual radial tabs could be provided instead of the flanges 7, but the strength would suffer as a result) center the coil C on the plate P and on the other hand prevent it from contracting inward. Moreover, the resulting orifice 11 makes it possible to center the plate P on base surfaces, for example if the latter possess projections 12 which enter the orifice 11, as shown in FIG. 3 for the loading station L.

Both a gripping means of relatively simple design, and the ribs 5 of the magazine stand 4, interact with this border 6. The flanges 7 are pushed onto the said ribs so that each rib enters the depression 8.

In principle, the coil-holding underlay P can be of any form but, in the embodiment shown, is such that the gripping means can be of a particularly simple design. The latter has a semicircular gripping tool 14 around an axle 13, the said tool being represented by solid lines in one position in FIGS. 1 and 2 and by dash-dot lines in two other positions and being such that it can engage the depression 8 between the flanges 7 of the border 6 in the manner shown in FIGS. 2 and 3 and can thus grip the coil C together with its underlay P. It is precisely to permit this gripping tool 14 to grip the coils C held in the magazine station M that the stand 4 is only semicircular. If the gripping tool 14 is raised slightly, the weight of the coil is supported on the said tool) and the coil, under its own weight, remains lying on the said tool through frictional contact. This lifting movement can be effected either by actuating the drive for the gripping tool or in the manner described below with reference to FIGS. 13 and 14.

As shown in particular in FIG. 3, a drive motor 15 is provided on the upper side of the gripping tool 14 to swivel the latter around the axle 13. The axle 13 is mast-like and serves as a guide column for an upward and downward movement of a bearing element 16 around which the gripping tool 14 can actually be swivelled. The bearing element 16 is equipped, at two end faces opposite one another, with extensions 17 to which a continuous traction means, such as a toothed belt, but preferably a chain 18, is fastened. The chain 18 is part of a transport means which—like an elevator in a building—is capable of executing an indexed movement, i.e. can only approach specific discrete stations or positions but no intermediate station. These stations correspond to the ribs 5 of stand 4; it is now evident why, in order to simplify the control, it is advantageous if the ribs 5 are spaced at regular intervals. Such elevator controls are known per se and therefore do not require any detailed explanation. A switch box 19 (FIG. 2) having selector buttons 20 can be arranged on the rear of the stand 4, by means of which buttons each individual rib 5 of the magazine station M as well as various rotary positions of the gripping tool 14 can be selected.

As soon as the gripping tool 14 grips a coil C, it can be brought, by appropriately energizing its motor 15, into the position 14' shown in FIGS. 1 and 2, or can be brought directly to the unwinding station H beforehand, where the coil is placed on a rotatably mounted table 21 which is merely indicated by a dashed line in FIG. 2. It is only after this that the gripping tool 14 swivels to position 14' in order to release the coil. The band-like blank material is then deflected through 90 degrees by means of a stationary guide 22 (which may, if desired, be omitted) so that it can be fed in the correct position to the punch press 1.

If the magazine station M is to be loaded, it is advantageous (although not absolutely essential) to provide a loading station L where the transported coils are first placed so that they can be gripped by the gripping tool 14 in the manner described and conveyed to a compartment (that is a particular rib 5) of the magazine station M which has been selected via selector buttons 20.

Figure 3A:
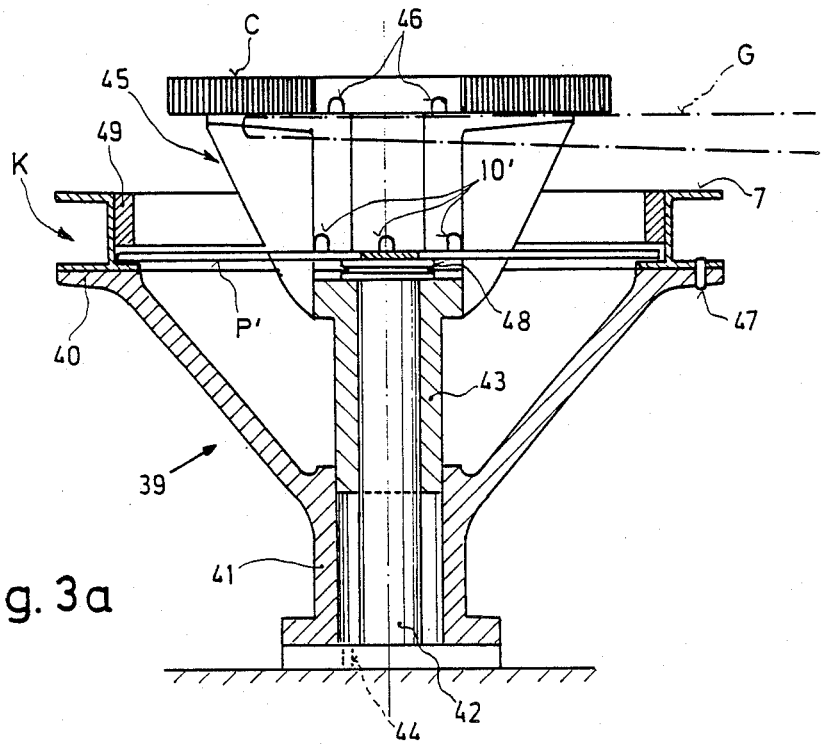
FIGS. 3*a* to 3*d* show a preferred embodiment of a loading and/or unwinding station as an axial cross-section (FIGS. 3*a*, 3*b*) in two different positions, and in plan view (FIG. 3*c*), FIG. 3*d* showing a detail in an axonometric view.
Figure 3B:
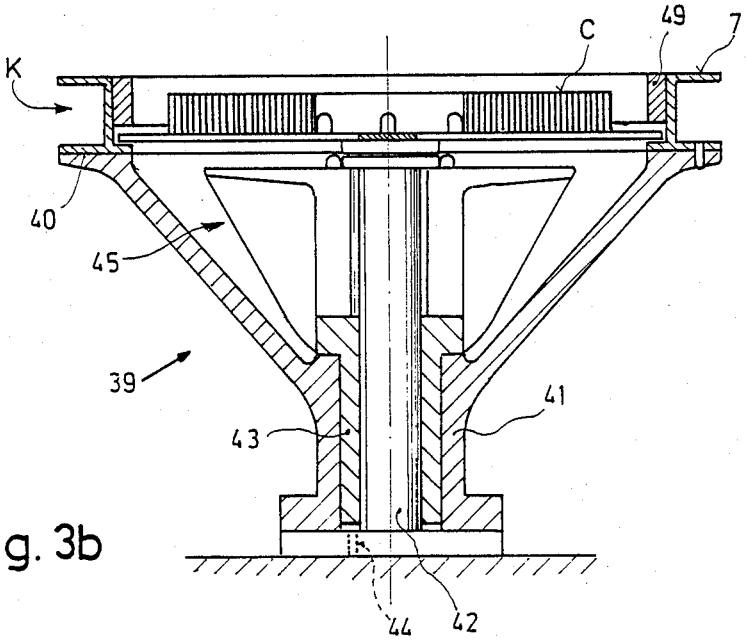
Figure 3C:
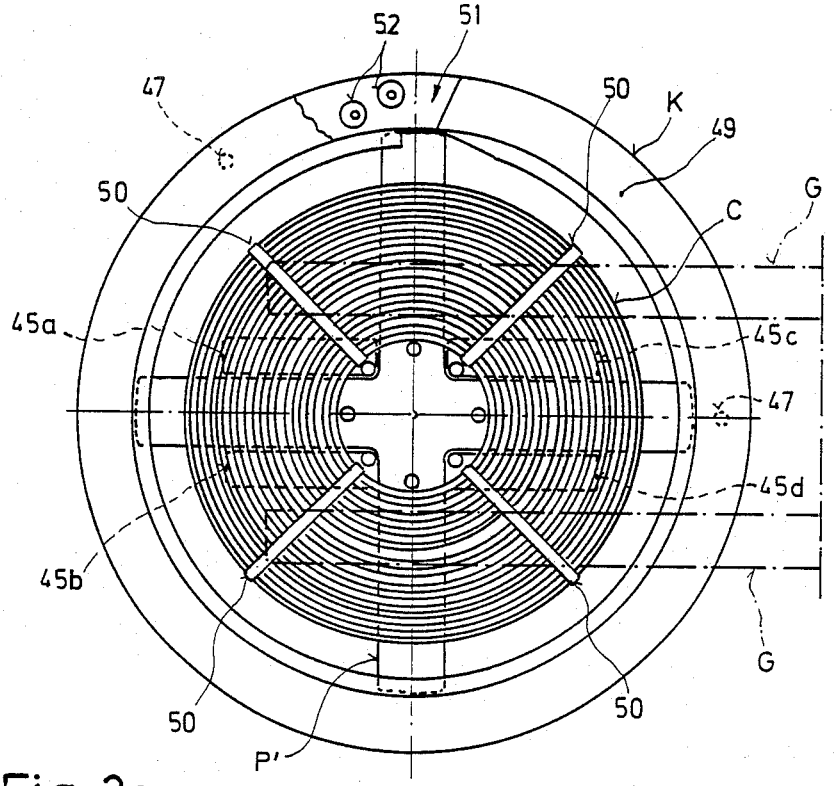

For this operation, FIGS. 3*a* to 3*c* show a particularly advantageous embodiment of a station, which preferably plays the role of the loading station L but may also be used for the unwinding station H. In this connection, it is also intended to discuss an advantageous embodiment of the cassette which holds the coil C.

The loading station according to FIGS. 3*a*, 3*b* has a stand 39 which possesses an annular support surface 40 at its upper end. The lower part of the stand 39 forms a cylinder 41, in the middle of which a guide rod or shaft 42 is arranged coaxially. If the station is used merely for charging cassettes K, the said rod may be a rigid guide rod 42, which may even be omitted. If, on the other hand, the coil C is to be rotated by means of a drive, as in the case of a winch or unwinding station H, the rotatably driven shaft 42 is employed.

A hollow cylindrical piston 43 which surrounds the rod or shaft 42 is displaceable inside the cylinder 41. Via an orifice 44, a pressure medium can be admitted to the cylinder 41 and discharged from the latter. By passing a pressure medium into the cylinder 41, the piston 43 is moved upward and reaches the position shown in FIG. 3*a*.

Figure 3D:
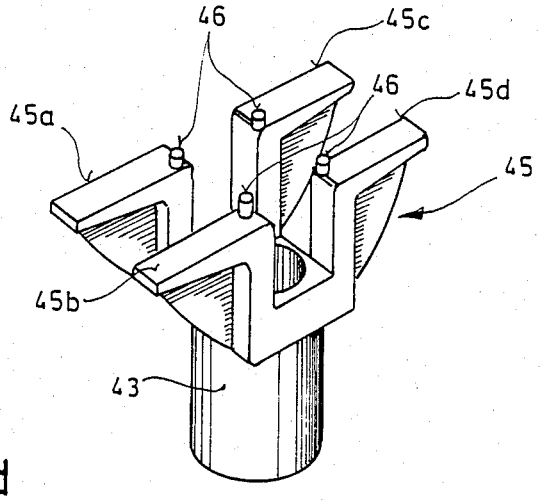

The piston 43 has the shape shown in FIG. 3*d* and, above its cylindrical section, has a supporting stand 45 having four arms 45*a* to 45*d* which extend approximately horizontally, pairs of these arms being parallel to one another. These arms 45*a* to 45*d* are each provided, in the central region, with a centering projection 46 which projects upward and whose purpose will be explained below.

If a cassette K is to be loaded with a coil C, the peripheral flanges 7 of the cassette K are placed on the support surface 40 and expediently secured in their position there with the aid of a fastening means. In the embodiment shown, this fastening means is formed by holes in the lower peripheral flange 7 and by pins 47 which pass through the support surface 40 and also secure a particular rotary position; however, any other fastening or position-securing means may be used, for example clamps which grip the peripheral flange laterally, or simply a raised border surrounding the surface 40.

A coil C is then transported by means of a fork-lift truck whose fork G is shown by a dot-dash line in FIGS. 3*a* and 3*c*. From the latter Figure, it is also possible to see that the purpose of the parallel orientation of the arms 45*a* to 45*d* of the piston 43 (cf FIG. 3*d*) is to permit the fork G to deliver the coil C and place it on the said arms. As shown in FIG. 3*a*, the centering projections 46 secure the coil C in a central position. However, it is evident that the centering projections 46 only effect preliminary centering, whereas final centering inside the cassette K is carried out using the retaining tabs which radially are somewhat further to the outside than the centering projections 46 and in this case are in the form of pins 10'.

These pins 10' are arranged on a cross-shaped underlay plate P'. It can be seen that the parallel arms 45*a* to 45*d* of the stand 45 are in each case a distance apart such that a crossbeam of the underlay plate P' can pass between them.

Thus, the form of the stand 45 makes it possible for the fork G, the stand arms 45*a* to 45*d* and the crossbeams of the underlay plate P' to be accommodated alongside one another without mutual interference.

The above embodiments show the importance of precise orientation of the parts with respect to one another. Hence, in order to bring an underlay plate P' into the correct position after the peripheral flange 7 of the cassette K has been placed on top (before the piston 43 is brought from the position shown in FIG. 3*b* into that shown in FIG. 3*a*), it is advantageous if the part 42, in the case of a loading station L, as well as in the case of an unwinding station H as mentioned above, is in the form of readily rotatable shaft, on whose turntable 48 the underlay plate P' is placed.

On the other hand, the cassette K can be placed in the correct position on the surface 40 right from the outset, and the position of the underlay plate P' can be fixed by means of a clamping ring 49 made of a soft material. In the present case, however, the purpose of the ring 49 is to prevent scratching of the band surface and jamming of the band between underlay plate P' and annular flange 7 during insertion of the coil C. Thus, the ring 49 primarily serves as a protective ring and expediently consists of plastic or of another soft material.

If the coil C is delivered by means of a fork-lift truck, the said coil must be secured in a conventional manner to prevent it from falling off. For this purpose, it is bound by tapes 50 (FIG. 3*c*). As soon as coil C has been placed on the stand 45 which has been brought to the position shown in FIG. 3*a*, the said stand is lowered to the position shown in FIG. 3*b*. If a rotary shaft 42 is provided, the beginning of the band can be gripped after the tapes 50 have been detached, and can be drawn through the cassette mouth 51, a slot in the peripheral wall of the cassette. It is advantageous if guide rollers 52 are provided in the region of the cassette mouth 51, in particular mounted on the peripheral flange 7, the said rollers ensuring satisfactory take-off of the band for any coil diameter. Details of the mounting for these rollers 52 in a preferred embodiment are described with reference to FIG. 9. The beginning of the band is then pulled forward until it projects by a certain amount from the cassette mouth 51. Expediently, any tapes 50 which still remain uncut are removed gradually with rotation of the coil. If the station shown also serves as a winch or unwinding station, the band can then be pulled off from coil C for processing.

Although it has already been suggested that the coils C be unwound from the inside outward, it can be seen that, in the system described, unwinding from the outer circumference is more expedient and more advantageous.

Figure 4:
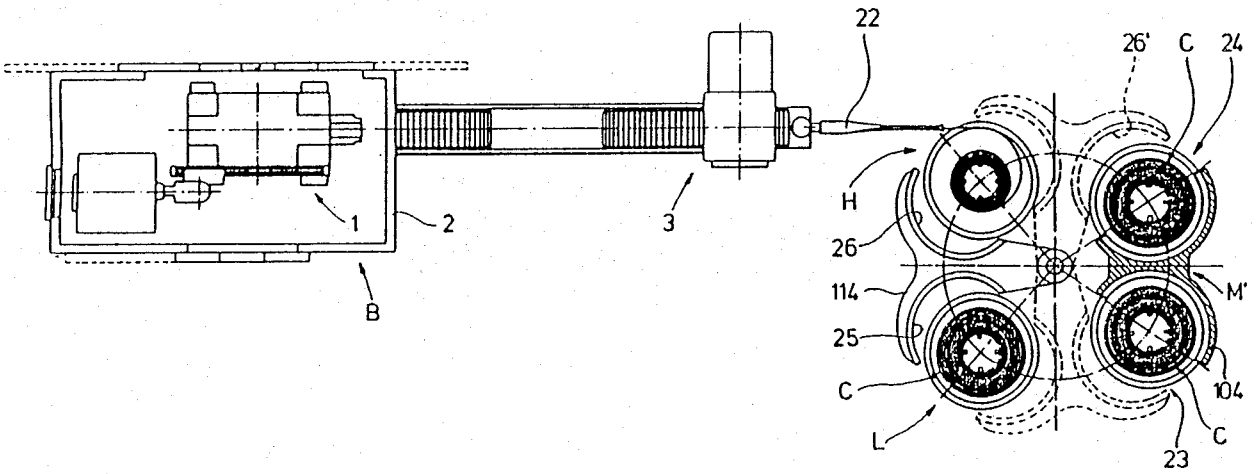
Figure 5:
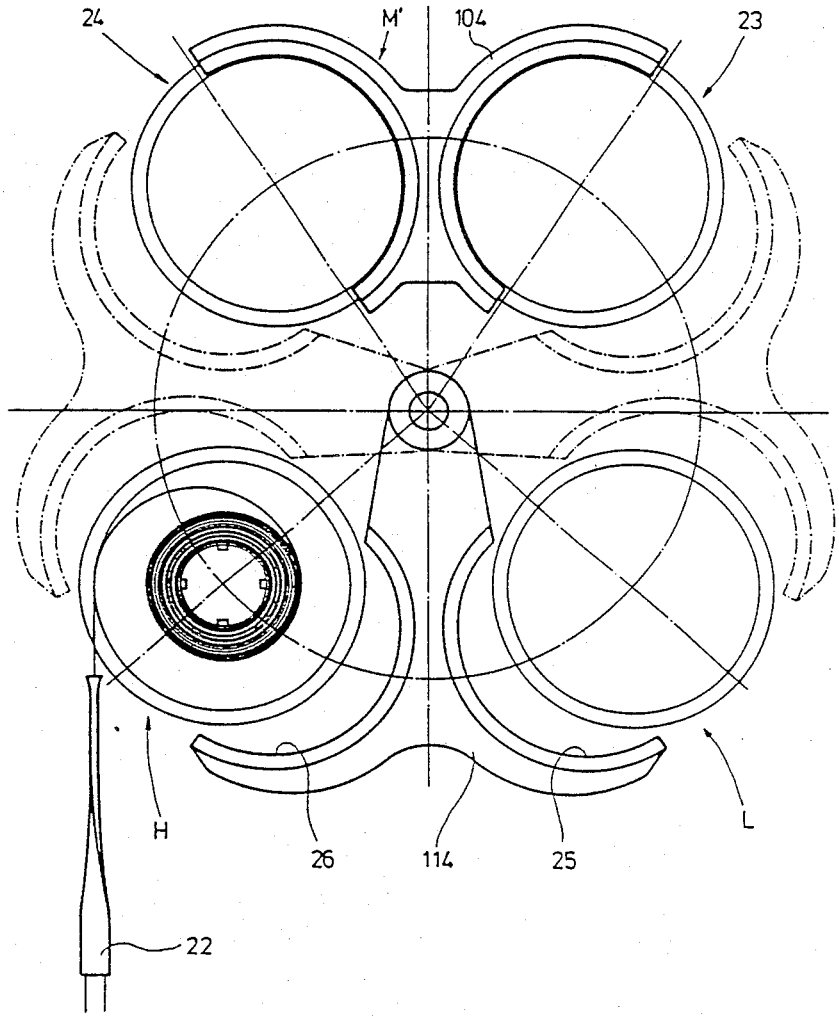
FIG. 5 is a portion on a larger scale, corresponding to FIG. 2.

The embodiment shown in FIGS. 4 and 5 differs from the example described above only in that a double magazine M' having a stand 104 is provided in order to house an even larger number of coils C. In order, nevertheless, to permit the coils C to be removed from both compartments 23, 24 formed in this way, without complicated movement mechanisms, the gripping tool 114 is provided with two semicircular gripping surfaces 25, 26 connected to one another, the surface 25 being assigned to compartment 23, and the surface 26 to compartment 24.

FIGS. 6*a*–6*c*, and 7 show details of a preferred embodiment at the unwinding station H. In this embodiment, the rotary table surface 21 is formed at the upper end of a cylindrical element 27 which either is itself mounted so that it can rotate around the axis 28 or has spheres or rollers on the surface 21 which facilitate rotation of the underlay P. In a manner similar to that shown for the loading station L in FIG. 3, and in FIGS. 3*a* to 3*d*, the cylinder 27 preferably has, at its upper end, a centering projection 112 which engages the orifice 11 of the underlay P. Around the cylindrical element 27, a support surface 29 is arranged which is slightly below the surface 21 and whose purpose is explained below.

Figure 6A:
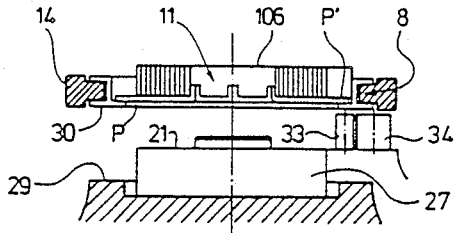

FIG. 6*a* shows the gripping tool 14 engaged in the depression 8 of the border 106. This border 106 differs from the border 6 of the embodiment described above (cf. FIG. 3) in that it is designed as a part which is separate from the underlay P' and possesses, on its lower face, a projection 30 which is directed radially inward and supports the disk-shaped underlay P'. By actuating the vertical transport means 18 (cf. FIG. 3), the gripping tool 14 is lowered and coil C together with underlay P' and border 106 is brought to the position shown in FIG. 6*b*. However, the border 106 does not remain there but falls under its own weight onto the support surface 29 (FIG. 6*c*). It is of course also possible, instead of a rigid cylinder 27, to provide a turntable 48 which can be raised and lowered, analogous to FIGS. 3*a* to 3*d*.

Figure 7:
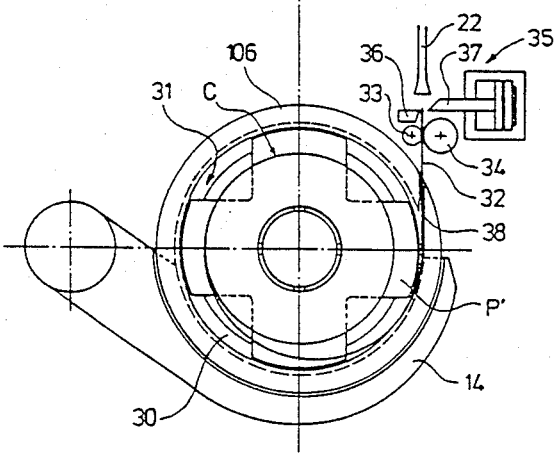

As shown in FIG. 7 and as already described with reference to FIGS. 3*a* to 3*d*, the underlay P' differs from the underlay P in that it is approximately cross-shaped in plan view. Nevertheless, the sections 31 which form the crossbeams have such a small area relative to the coil C that no disadvantages are to be feared.

FIG. 7 furthermore shows that the gripping tool 14 delivers the coil C with the band end 32 already projecting (cf. description for FIG. 3*d*), the said band end then being pulled off from the coil by two transport rollers 33, 34, similarly to a capstan drive in tape recorders, and being inserted into the band guide 22 which turns the band through 90 degrees. A cutter 35 consisting of a stationary part, forming a scissor edge, and a piston-operated movable part 37 is arranged downstream of the transport rollers 33, 34 in order to ensure that, when the punching process is complete, the band is parted in such a way that a band end 32 projecting between the rollers 33, 34 once again remains. The gripper 14 can then grip the border 106 lying on the support surface 29 and lift it vertically so that it holds the underlay P', whereupon the coil C together with underlay P' and border 106 is inserted into the magazine station M in the manner described above.

In order to allow band end 32 to project beyond the border 106, the latter is provided with an approximately tangential slot 38; this slot can be relatively wide, so that the band end 32 can easily be taken up again when the border 106 is raised from the position shown in FIG. 6c. For this purpose, the slot 38 can widen slightly in an upward direction in a funnel-like manner. It is also possible for the slot 38, in plan view (FIG. 7), to extend slightly toward the inside of the border 106. In a preferred embodiment not shown here, instead of the slot 38, a swivel element possessing the slot 38 is pivotably mounted in a recess of the border so as to align itself tangentially with the coil C inside the border 106, in conformity with the size of the coil C.

Within the scope of the invention, a large number of modifications are possible; for example, it is not necessary to connect the gripping tool 14 to a transport means 18; instead, the gripping tool 14 may be vertically displaceable only to a small extent, if at all, while the magazine station has a continuous conveyor for the coils. However, the embodiment shown is of course of simpler design and moreover ensures high packing density for the coils, so that it is possible to manage with a small amount of space.

In another possible modification, instead of the depression 8 in the border 6 or 106, a single extension, for example one which continues right around, or a plurality of tab-like extensions is provided. Similarly, instead of an annular depression 8, a number of depressions can be arranged at intervals right around, for example to permit gripping by a gripper claw.

Figure 6B:
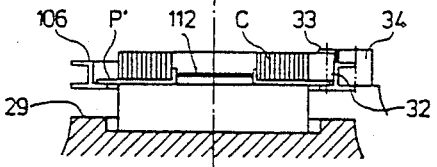
Figure 6C:
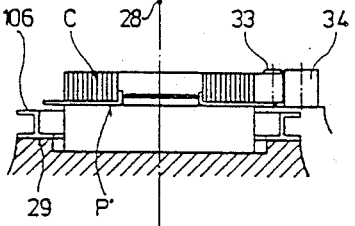

Furthermore, the procedure described with reference to FIGS. 6a–6c is not absolutely essential. For example, to simplify control of the gripping tool 14, which has to reach different heights during placing of the coil on the surface 21 and during removal of the border 106 from the surface 29, it is possible for the cylindrical element 27 to be designed similarly to the turntable 48 (FIGS. 3a–3d) so that it can move up and down, the said cylinder element normally having its upper surface 21 at the same level as the support surface 29 and being raised from this position to the height shown in FIGS. 6a–6c before the drive for the rollers 33, 34 is switched on.

Figure 8:
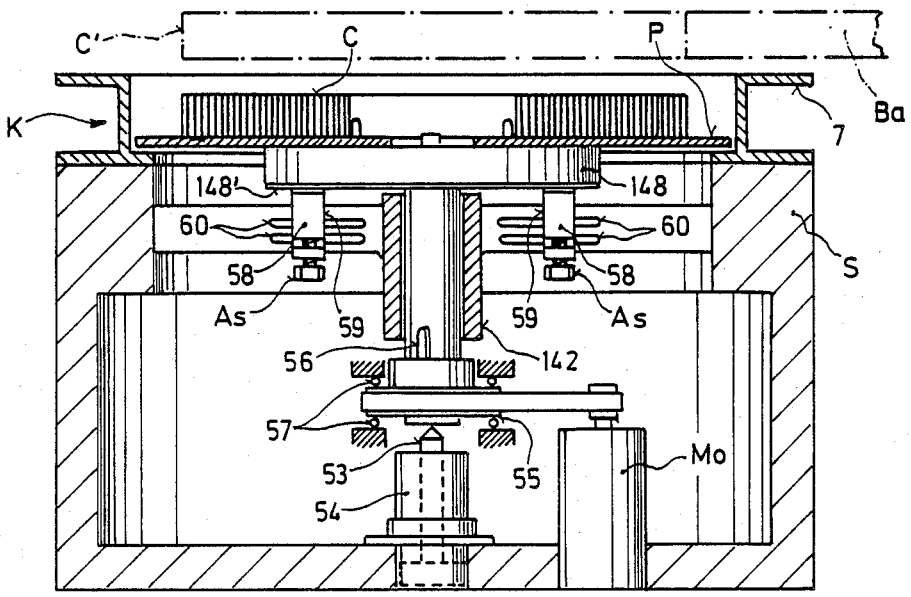
FIG. 8 shows an axial section through a particularly advantageous modification of an unwinding station.

Such a modified embodiment of an unwinding station is shown in FIG. 8. In this embodiment, a turntable 148 is provided on which the underlay plate P of the cassette K rests. The turntable 148 is connected to a shaft 142 which can be brought, via an axially displaceable bearing pin 53, into a position in which the coil C assumes its position C' outside the peripheral flange 7, this position being indicated by a dash-dot line. In this position, the band Ba can be freely taken off. It is evident that lifting the coil out of the cassette part with its peripheral flange 7 is particularly advantageous where simple cassette constructions without a cassette mouth are used, since otherwise the coil can remain inside the cassette when the band is taken off.

The shaft 142 is raised with the aid of an axial drive which is inserted in the base of a housing S and which may be in the form of a solenoid, but, in view of the great weight of the coil, is expediently in the form of a pressure cylinder 54 to which a pneumatic or hydraulic pressure medium can be fed in a manner not shown.

Since the drive of the shaft 142 is expediently stationary, a wheel 55 which can be driven by a motor Mo is expediently rotatably connected to the shaft 142 by means of a spline connection 56, but permits axial movement of the shaft 142. Thus, the wheel 55 is held in its position by axial bearing 57.

Since the coils can be of different sizes and widths, their weights also differ very greatly. Thus, if the drive is to be shut down, very different inertial forces are active and make braking more difficult, so that there is always a tendency for undesired subsequent unwinding. Regardless whether the coil—in the case of simple cassette construction—is unwound outside the actual cassette, in the position C', or—where a cassette mouth 51 is present—can remain inside the cassette K, it is advantageous to provide a turntable 148 which can be raised at least slightly. The reason for this is a particularly effective brake construction, which will be described below with reference to FIG. 8.

As soon as the rotary drive, which may be put into operation only with the coil slightly raised inside the cassette K, is switched off with the motor Mo, the pressure medium in the pressure cylinder 54 is rapidly discharged so that the turntable 148 drops again. A braking surface 148', which then comes into contact with counter-braking surfaces on braking elements 58, is present on the underneath of the turntable 148. The braking elements 58 expediently rest on adjusting supports 59 and are adjustable in height with the aid of adjusting screws As, in order to be able to compensate wear of the braking surfaces on the one hand and to permit adjustment of the braking time on the other hand. Moreover, the adjusting supports 59 are slidable and fixable in horizontal slots 60 in order to be able to adjust the radial position relative to the turntable 148 and hence the effective braking torque. Since the weight of the particular coil C resting on the turntable 148 acts on the latter and determines the friction, the braking effect is automatically adapted to the particular weight of the coil Co. If desired, the motor Mo may additionally possess a braking circuit or a countercurrent circuit (for regenerative braking).

A take-off means together with an expedient embodiment of the region of the cassette mouth 51 of the cassette K is described with reference to FIGS. 9, 9a. Of the two guide rollers 52, which have already been described with reference to FIG. 3c, one guide roller 52'' is stationary on peripheral flange 7, whereas the guide roller 52' is located on the swivel axle 61 of a two-armed lever 62. The lever 62 is loaded at one end by means of a pressure spring 63 and, at its opposite end, possesses a clamping element 64 which presses the band Ba against a clamping block 65 and thus prevents the pulled-out end of the band Ba from winding or unwinding further. This ensures that a predetermined length of the relatively stiff band Ba always projects from the cassette mouth 51.

The unwinding station H is expediently provided with the above-mentioned take-off means 3, which has a housing Ca. Inside the housing Ca, a guide frame 66 is mounted so that it is readily rotatable around a swivel axle A. The swivel axle A is located approximately in the region of the cassette mouth 51.

In the case of the arrangement of the band brake formed by clamping element 64 and clamping block 65, the guide frame 66 is provided with a release mechanism for the brake, which has, for example, a rod 68 which is opposite that end of the lever 62 spring-loaded by pressure spring 63 and which can be actuated by piston 67. By advancing the rod 68, the lever 62 is rotated in a clockwise direction against the force of the spring 63, the clamping element 64 being raised from the clamping block 65.

As soon as the band brake is released (or expediently before this), a piston 69 is displaced to the right (based on FIG. 9), the said piston carrying on its piston rod a cutting blade 70 on the one hand and a spring-loaded clamping ram 71 on the other hand, which lies opposite a clamping surface 72. Since the clamping ram 71 projects beyond the blade 70, when it advances it clamps the band firmly before the blade 70 can come into effect.

If the piston 69 is then displaced through only part of its stroke, the band Ba will merely be clamped, but the blade 70 will not come into operation. The band brake 64, 65 is preferably released only at this point, so that the band Ba is securely held rigid up to this time.

A slide Sc which is guided on guide columns gc and to which the means 69–72 is attached can then be displaced downward—based on FIG. 9—by actuating a piston 73, the slide Sc reaching the position Sc' indicated by a dashed line. Since the band end is firmly clamped at the surfaces 71, 72 and even projects slightly beyond guide rollers 74, in position Sc' of the slide Sc, it enters the region of a further clamping means having two clamping pistons cp (or at least one piston which is located opposite a rigid clamping surface). If the band end Ba' has not yet assumed the position shown in FIG. 9 (for example, for geometrical or constructional reasons), the slide Sc can execute a further stroke. Expediently, the piston 67 is again moved to the left for this purpose (by admitting a pressure medium in a manner not shown), so that the band brake 64, 65 is closed again. At the same time, the clamping means cp too may be closed in order to hold the band Ba rigid. The slide Sc can then return to the position indicated by solid lines, in which it again moves the clamping ram 71 against the clamping surface 72, while the band brake 64, 65 (and the clamping means cp, if this has been closed) is opened. By again advancing the slide Sc to the position Sc', another piece of band can be transported forward in an intermittent movement.

In general, the particular construction and its dimensions will show whether a single advance is sufficient to bring the band end to the point Ba', or whether a double, or even multiple, advance is required. Since the number of movements of the slide Sc depends on the dimensions, it is generally sufficient to provide for a predetermined number of movements of the slide between its position indicated by solid lines and the position Sc'. However, if the band length projecting from the cassette K is subjected to large tolerances, a light barrier may be arranged at the position Ba', the said light barrier indicating the arrival of the band end at that point or preventing further movements of the slide. For example, such a light barrier can have two photocells arranged one behind the other, one of which is covered and the other illuminated when the band end is in the correct position.

The clamping means cp is located on a further slide Sc2, which can be activated by a cylinder unit cy. This slide Sc2 can be provided with separate guides, or the guide columns gc can simply be extended. The clamping pistons cp are located in a rotary ring cr, which can be driven via a gear ring 75 by a motor 76 or another drive unit, via a gear which is not shown, to perform a rotation of 90 degrees. For this purpose, the rotary ring cr is rotatably mounted in a cage cg.

As soon as the band end is in position Ba' and the clamping means cp has closed, the cylinder unit cy is actuated and draws the slide Sc2 to the position Sc2'. In this position, Sc2' (or during the movement of the slide Sc2 to this position), the rotary ring cr is rotated through 90 degrees with the aid of its drive 76, so that the band Ba lies flat in the manner shown so that it can be brought onto a take-off roll, which feeds the band Ba to the processing station B (cf.- FIG. 1).

If the band Ba in position Sc2' of the slide Sc2 is rotated through 90 degrees, the slide Sc2 moves to a position Sc2'' and, in this position, transfers the band Ba to the take-off rolls ro (only one is shown), which grip it and pass it on to the processing station B. It is important that the band Ba is always centered as it passes onto the take-off rolls ro. On the other hand, this condition cannot readily be fulfilled since in fact the various coils have different band widths. Hence, when one edge of the band Ba is fixed by its position in the unwinding station H, the other edge extends upward from this to a greater or lesser extent, depending on the band width.

In order to compensate this and to center the band Ba on the take-off rolls ro, a sensor means is provided which senses the band width and accordingly swivels the guide frame 66 about its axle A. The sensor means may be of any type, for example of a mechanical (stylus resting against the band edge) or pneumatic type (jet nozzles which blow against the edge and whose counterpressure is measured).

In the present embodiment, however, a number of photodetectors 77 are arranged on the guide frame 66 close to the cassette mouth 51, the individual photoelectric transducers, for example photoresistors pl to pn (FIG. 9*a*), extending at right angles to the plane of FIG. 9 and hence transversely over the width of the band Ba. This sensor means 77 receives light from a light source li which, at least at the beginning of the take-off process, throws a beam of light (indicated by a dashed line in FIG. 9) at the band Ba, which reflects it to the sensor means 77.

FIG. 9*a* illustrates the resulting situation. It is assumed that, because of the width of the band Ba, out of the five photoelectric transducers pl to pn shown only the resistors pl to p3 receive reflected light, whereas no light is transmitted to the resistors p5 and pn. Starting from a supply line s1, the individual photoelectric transducers pl to pn are connected to one another by resistors by R1 to R4, an output line o1 being connected to the transducer pn and to the resistor R4. Thus, depending on the number of illuminated transducers pl to pn, the signal fed to output line o1 is reduced by the number of resistors R1 to R4 switched in, so that a stepped, clearly recognizable signal is produced in line o1, the voltage of the said signal being dependent on the band width determined.

At the same time this width-dependent signal is produced in the output line o1 of the sensor means 77 shown in FIG. 9*a* (which as discussed above is tilted through 90 degrees with respect to FIG. 9), a reference value is also supplied on a reference line r1, the reference value being set by means of a control element ra. This reference value is fed to a comparison stage co whose output signal is fed to a drive stage 78, for example a transistor bridge for a motor 79 whose rotation can be reversed. The entire system is virtually a follow-up control, since the motor 79, which is also shown in FIG. 9, interacts, via its pinion pi, with a toothed segment Ts which is connected to the guide frame 66 and is curved around the axle A, and by means of which the guide frame 66 can be swivelled around the axle A. The rotation takes place only through a small angular range, and it is evident why it is advantageous to arrange the axle A in the region of the cassette mouth or of the take-off end, since this keeps the deflection in this region small and thus prevents susceptibility to faults.

As soon as work with the coil is to be ended, the band aligning apparatus (not shown) of the punch press (station B) is stopped and the piston 69 is operated, in this case however over the full length of its stroke, or with full force. In this way, the cutting edge 70 is moved toward the band Ba and past a counter-edge 70*a* at the end of the clamping surface 72 and parts the band so that the predetermined length of the band end once again projects from the cassette mouth 51. The separated part, which in FIG. 9 is moving downward, then continues to be fed via the takeoff rolls ro to the punch press, and processing is completed. The piston 67 is then moved to the left in order to bring the clamping element 64 into contact with the clamping block 65 and thus fix the band Ba. It may then be expedient to bring the slide Sc to the position Sc', where it is less exposed. Furthermore, the delivery slide Sc2 is returned to the position shown by solid lines, and coil C can be changed.

There are of course a large number of possible modifications of the take-off means. For example, instead of the clamps cp which are rotatable through 90 degrees, it is also possible to provide nonrotatable holding means, if necessary even rolls, and the rolls ro, as proposed above, may be rotatable through 90 degrees. It is also advantageous if the take-off means is designed so that it is completely or partly laterally displaceable, in order to improve accessibility to the alignment machine.

The form of a magazine station M with a limited number of stored coils, in particular for only one processing station P, has been described above with reference to FIGS. 1 and 4. However, it is also possible to assign a plurality of processing stations to one magazine station. In this case, in addition to the magazine compartments 23, 24 of FIG. 4, it is possible to provide at least one third magazine compartment on a rotary drum, which turns the particular magazine compartment desired so that it faces the stationary gripper. However, it should be noted that, in view of the high weight of an individual coil, a magazine compartment 23 or 24 weighs several tons, and it is therefore more advantageous in terms of energy if, instead of the magazine, the gripper is designed to be mobile.

An embodiment of this type of magazine station will be described below with reference to FIGS. 10 to 12. In this embodiment, a trolley ct can be moved in a magazine space M" (FIG. 10) along an axis 80, on rails r1 (FIGS. 11, 12) in the floor. However, the freely mobile gripper with its tool 114 presents safety problems since, according to the regulations in some countries, the operator must be prevented from gaining access to the working space of a gripper or handling device. For this reason, the magazine M" is surrounded by walls w1 on the one hand, and on the other hand a special construction of the individual magazine compartments is expediently chosen, this construction giving a stable structure which closes to the outside.

While in the embodiment according to FIG. 2 a semicylindrical stand 4 which fits the circumference of the cassettes is provided, in this case a polygonal stand construction 204 is expediently used. Each of these stands 204 has lateral surfaces ls lying in a plane at right angles to the axis 80, and the lateral surfaces ls of two adjacent stands 204 can easily be connected to one another, for example being screwed to one another. This gives a wall which is closed to the outside, and at the same time a very stable construction. As FIG. 14 also shows particularly clearly, it is preferable if the stand construction 204 does not surround the cassettes K fully to the middle, so that the center of gravity of the cassette K lies outside the stand 204. In FIG. 10, furthermore, the centers of gravity of the cassettes lie along an axis 80' parallel to the axis 80 or, expediently, also along a further axis 80" outside the stand constructions 204. As a result, the cassettes tip slightly forward, as will be described in detail below with reference to FIGS. 13 and 14, and jam, inter alia, thereby providing a clamping effect at the rear of the stand construction, where, if necessary for reinforcing this clamping effect, a recess re can be provided, in which the annular ribs 5 (cf. FIG. 3) are interrupted.

As in the installations described above, in this case too at least one loading station L is provided, which corresponds, for example, to FIGS. 3*a* to 3*d*. However, since the unwinding stations H are only of limited height, a magazine compartment 123 (cf. FIGS. 11, 12) can be mounted above this, over half the height. In FIG. 10, a magazine compartment 123 is cut away on the left-hand side, or only indicated by a dash-dot line, in order to show the unwinding station H underneath (for example corresponding to that shown in FIGS. 6*a* to 6*c*).

Particularly for the half-hexagonal shape of the magazine stands shown, the arrangement and number of stands and of the various stations can of course be varied to a great extent. In FIG. 10, four unwinding stations H are shown by way of example, these stations being equipped with take-off means 3 according to FIG. 9. Expediently, the magazine M" can be entered through a door 81 which is equipped with a door switch S1 by which, when the door 81 is opened, for example via a flip-flop FF, the drive circuit for the handling device with the tool 114 is broken However, in the event of a fault in the handling device, it may be desirable to be able to examine the said device in operation, and for this reason a manually operated bridging switch S2 may be provided. The switches S1, S2 are expediently connected to a switch box 119, mounted on the trolley ct, in the manner clearly shown in FIG. 11, via the rails r1 and sliding brackets 82, 82' and 82Δ which are in contact with the said rails, and bracket 82' being assigned to two power rails 83 in the manner shown in FIG. 12, the said power rails being accessible only through a small slot in the floor. In contrast, all low-current signals, as discussed below, are fed via the rails r1.

Figure 11:
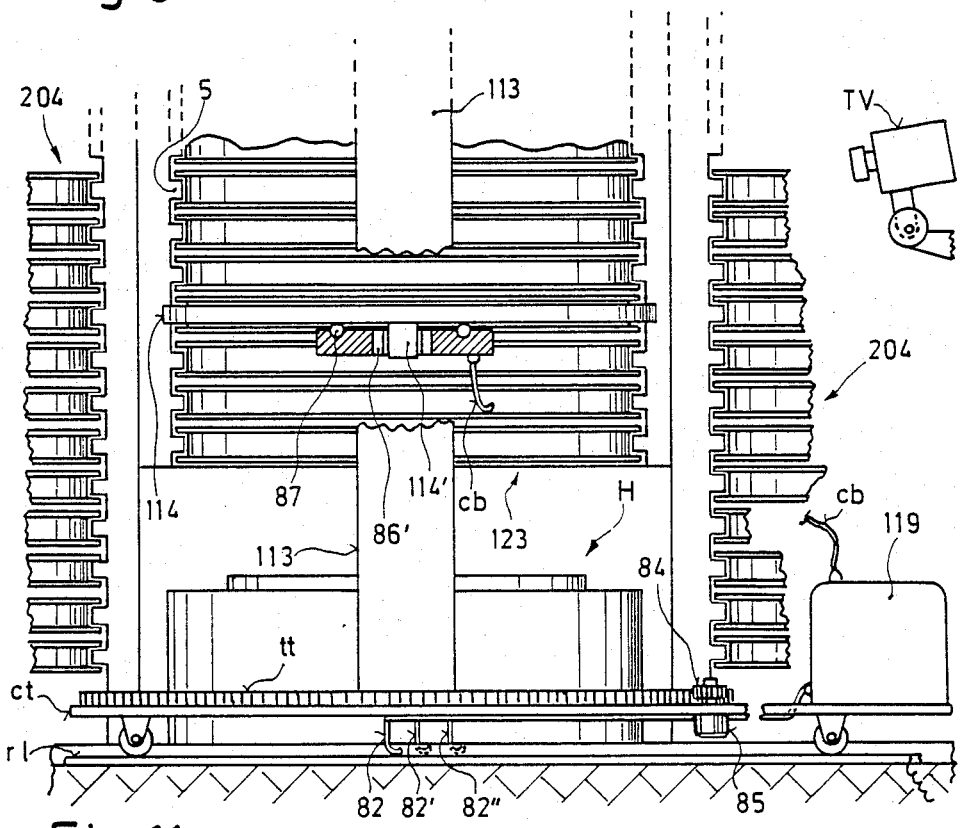
FIG. 11 is a view along the line XI—XI and FIG. 12 is a view along the line XII—XII of FIG. 10, and FIGS. 13 and 14 show details of the processes taking place during removal of coils from a preferred embodiment of a magazine station.
Figure 12:
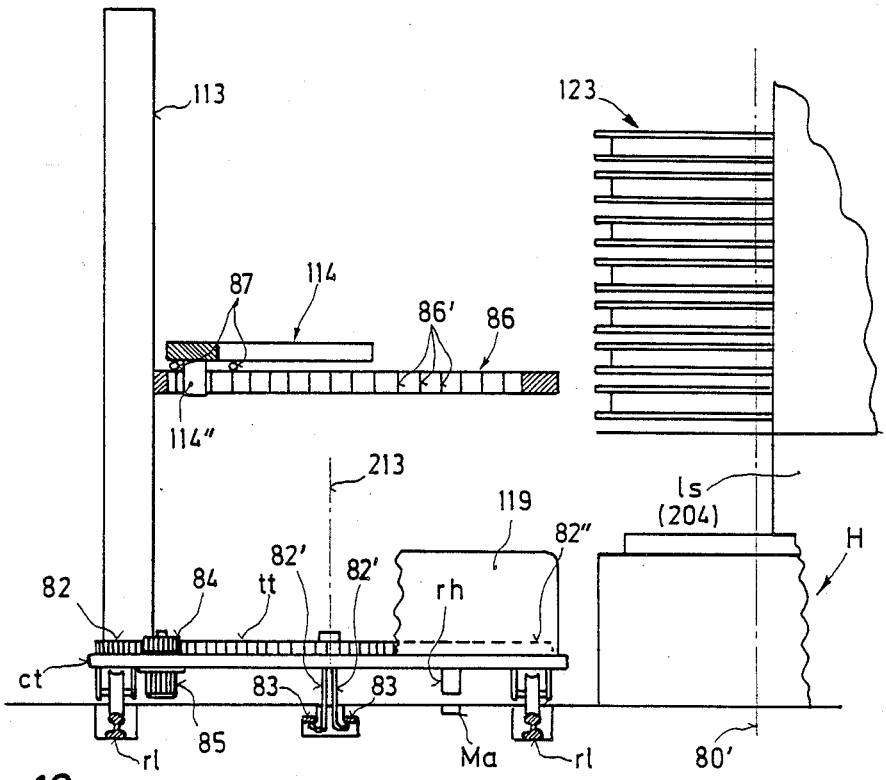

As shown in particular in FIGS. 11 and 12, a turntable tt which can be rotated about an axle 213 is arranged on the trolley ct. A mast 113 similar to that described with reference to mast 13 with the drive 17, 18 of FIG. 3 is arranged on turntable tt, although this mast itself is not the swivel axis, the swivel axis being rather the axis of rotation 213. The turntable tt possesses, on its outer periphery, a toothed system which is engaged by the pinion 84 of a motor 85. In this way, the gripping tool 114 can be rotated in every direction.

Figure 10:
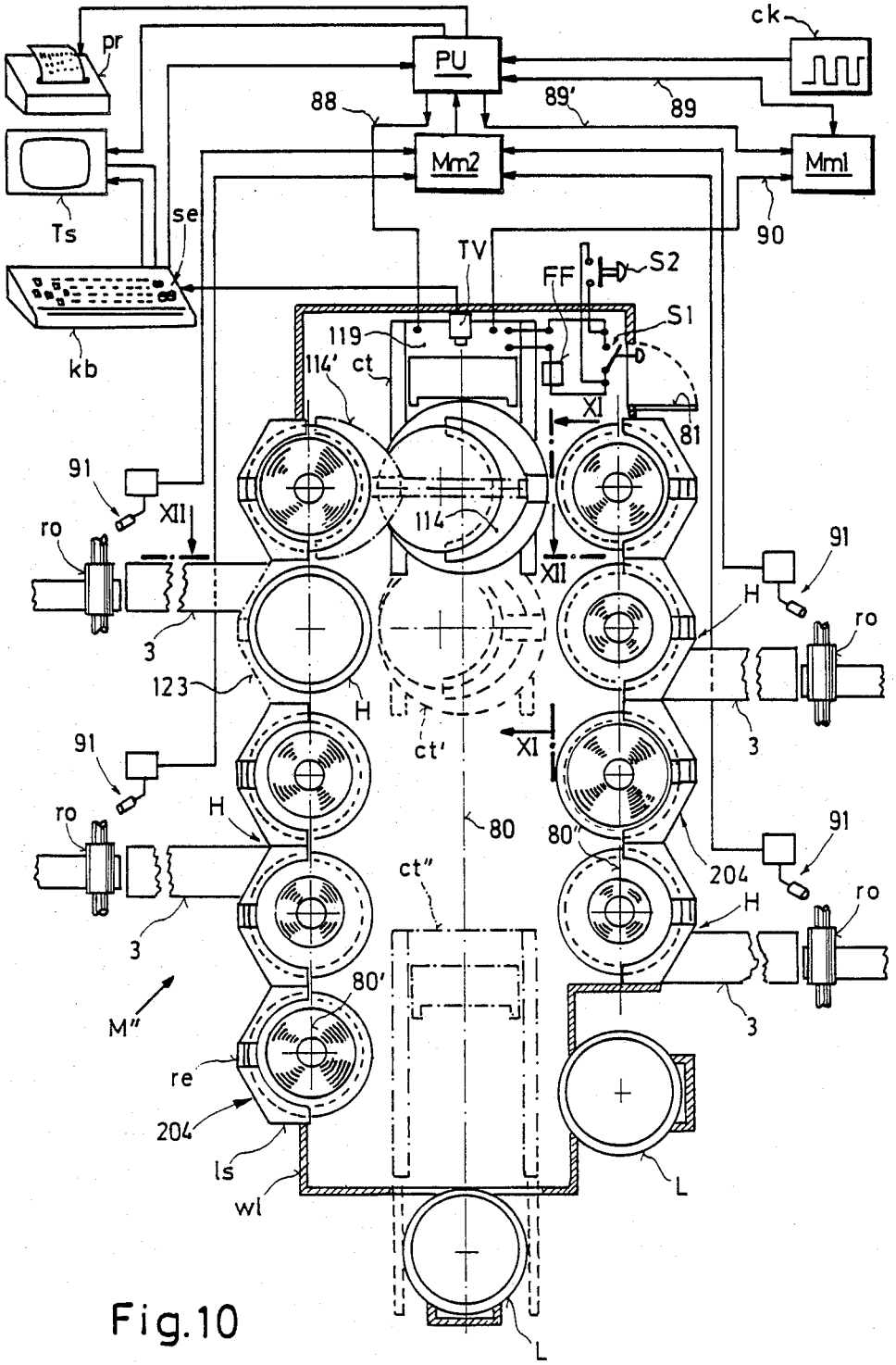

The gripping tool 114 is shown from the rear in FIG. 11 and in a cross-section through its central axis in FIG. 12, and, in contrast to the embodiments described hitherto, can be moved from the position shown in FIG. 10 and represented by solid lines to the position 114' represented by dash-dot lines. For this purpose, any drive, in particular a fluidic drive, can be provided, although in the present case a guide rail 86 (see, especially, FIG. 12) is used, the said rail being provided with the windings 86' of a linear motor. Since the rail 86 projects relatively far and is exposed to high loads from the coils, it may be provided with lateral arms (for example T-shaped or Y-shaped in plan view) which are supported by additional masts (corresponding to the mast 113) at their ends.

In any case, the gripping tool is provided with a corresponding travelling pole 114', which interacts with the poles 86' of the rail 86. A roller bearing 87, which is only indicated in FIG. 12, is expediently also provided on the rail 86. A cable cb (FIG. 11) provides the power supply. Thus, the gripper is equipped with a first straight-line guide system (rails r1) and with a second straight-line guide system 86 which is rotatable about a vertical axis; this provides high stability.

Since it is known that the weight of the coils can be extremely high, for stability reasons it is advantageous if, instead of a mast 113, two masts are connected to form a portal. In this case, the two masts are expediently arranged on both sides of the rail 86 and not behind it, as shown in FIGS. 11 and 12 in the case of a single mast 113.

FIG. 10 shows clearly that the trolley ct must be guided along the axis 80 to various positions, for example ct' in front of an unwinding station H or ct'' in front of the right-hand loading station L, and these positions must be addressed accurately. For this purpose, markings Ma (FIG. 12) can be produced in the floor, and these markings may take any form. For example, they may be reflecting optical markings, although induction loops have in general proven useful for similar purposes. These markings Ma can be scanned with the aid of a reading head rh (FIG. 12) mounted underneath the trolley ct. Similar controls are known per se, so that no detailed description is required here. The approach, or addressing, should in any case be sufficiently accurate that, when the gripping tool 114 is driven out, it reliably engages between the peripheral flanges 7 of the cassette in the manner described above, as will also be described in detail with reference to FIGS. 13 and 14.

The gripping tool 114 is controlled from outside the magazine space M'' by means of a control and process control system with a processing unit PU (FIG. 10), which is connected to the control box 119 via a line 88. The line 88 is merely a symbol, since it has already been mentioned above that the signals are expediently fed via the rails r1. Alternatively, radiocontrol will also be possible.

The particular gripper position desired (position of the trolley ct, of the turntable tt and on the mast 113) is input via a keyboard kb, the position of the individual coils, the material, the band width etc. being stored in a memory Mm1, which exchanges information with the processing unit PU via lines 89, 89'. This memory receives all position reports from the handling device via a line 90 from control box 119, this line being similar to line 88.

To permit the gripping work to be checked visually, at least one television camera TV (cf. FIG. 11) can be provided, whose picture can be brought to a monitor Ts. However, this is expediently also used for calling data from the processing unit PU; for this reason, the keyboard kb is provided with a selector switch se by means of which alternatively the television camera TV or the processing unit PU can be connected. It is also expedient if a printer pr is provided for printing out data.

Since all data on the available material (coils) is present in the memory Mm1, it is possible to carry out inventory processing and/or order processing via the processing unit PU. For example, orders frequently have to be processed in several part deliveries; for this purpose, at least one further memory Mm2 is expediently available, the residual amounts of each order and their delivery date being related to the existing quantities in stock. This memory Mm2 is also connected to revolution counters 91 on the unwinding or processing stations, where the work of material fed, for example to the take-off rolls ro, is monitored. This also makes it possible to monitor progress of order processing, to record machine shutdowns (the processing unit PU is also connected to a clock ck for this purpose), to calculate any piecework pay or to display machine servicing times. Since, in the memory Mm1, the material price is expediently also assigned to the particular coil addresses, the processor system described can also be used for carrying out costing, and if necessary also tendering.

However, calculation of material prices and cost accounting can also be automated so that the weight of the coil before and after unwinding is used as a base parameter. For this purpose, a weighing cell can be provided at a station according to FIG. 8, the said cell being installed on the upper surface of the turntable 148 and, if necessary, sensing the weight of the coil via the bearing pin 53. Since the coil is also braked, the weighing cell can also be connected to the brake 58; briefly, in a station of this type in particular, there are a number of possible ways of mounting such a weighing cell. The weighing cell may simply be in the form of a strain gage on the part under load. Such weighing cells can also be provided in the individual magazine compartments, where they can additionally monitor the occupancy of these compartments, so that the gripper need not approach an empty magazine compartment; however, there are also a large number of other, generally cheaper possible solutions for the last-mentioned purpose, for example an optical sensor on the gripper itself.

It has already been mentioned above that it is expedient if the axis 80' or 80'' running through the centers of gravity of the cassettes is arranged outside the stands. This results in the cassettes being in a slightly inclined position, which causes them to be jammed and hence secured in their position. However, this also makes removal more difficult for the gripping tool. The way in which removal can nevertheless be effected will be explained below with reference to FIGS. 13 and 14.

In a modification of the stands described above, in those according to FIGS. 13 and 14 (shown only in partial section) the annular ribs 5 extend laterally in the form of thinner webs 105 which possess at their end, for example, a thicker support 5*a*. If a cassette rests in a rib 5, as shown in representation a) of FIG. 13, its annular flanges 7 rest on the support 5*a*, as on a knife-edge bearing, on the one hand, while on the other hand the lower flange 7 is supported against the annular rib 5. If the resulting friction is insufficient to secure the cassette in its position, it is easy also to provide positive securing, for example by providing the lower flange with upward projecting extensions which engage depressions in the rib 5 or-more advantageously—by providing the annular rib with a projection which is directed downward and engages a corresponding orifice in the lower flange 7. However, this projection is only permitted to be short, so that the removal of the cassette is not hindered. Nevertheless, it is advantageous if the cassette K is always brought into a certain alignment, the rear of the cassette then possessing the recess for engagement of the projection discussed.

Figure 14:
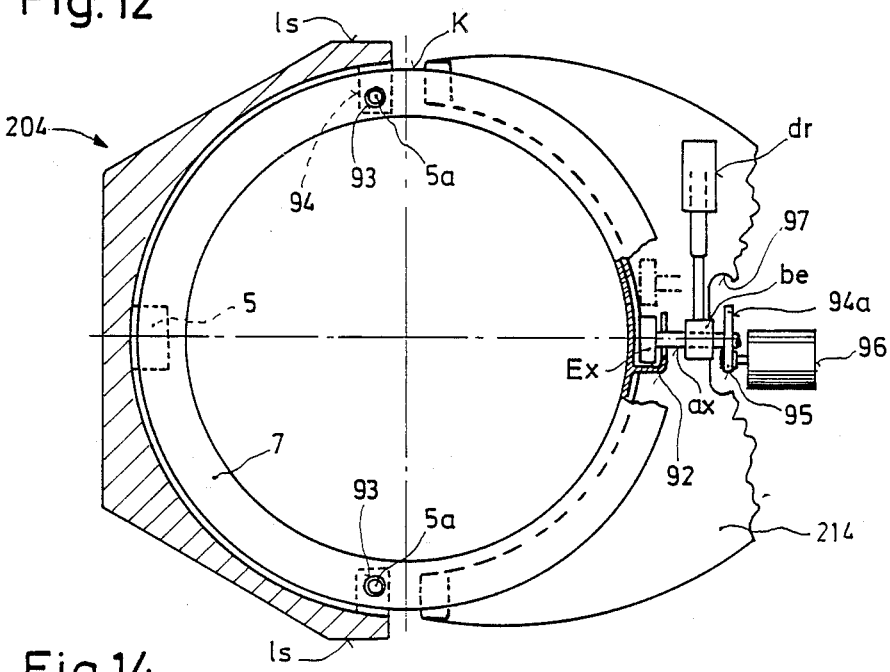
Figure 13:
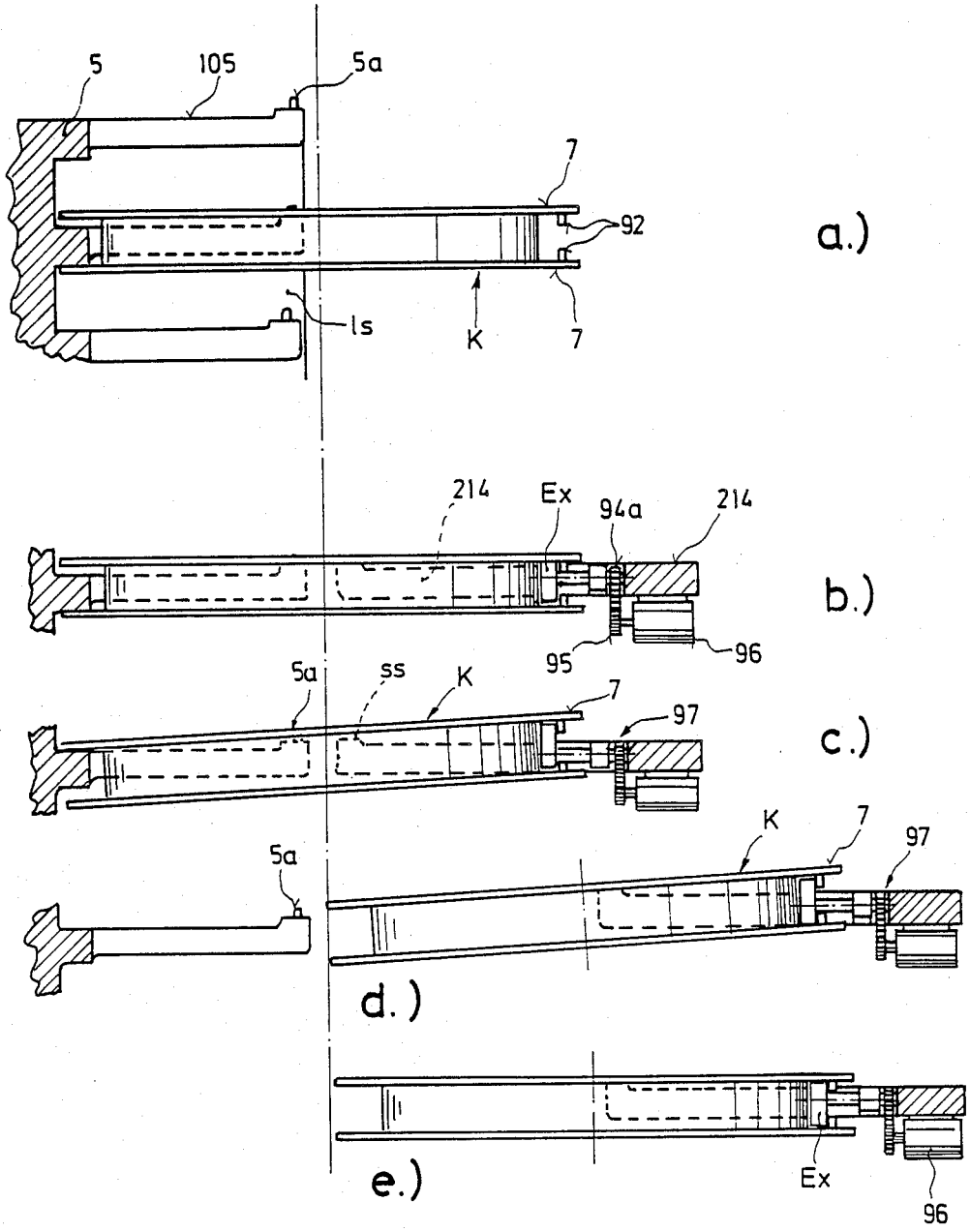

On the other hand, in the embodiment described, the front of the cassette K has a locking sheet 92, which is most readily recognizable from FIG. 14 and is forked toward one side as shown in FIG. 13. If the cassette in any case has to be oriented in a certain direction, it is possible for the supports 5*a* to be in the form of fixing pins in the manner shown, these pins engaging orifices 93 (FIG. 14) in the peripheral flanges 7. In this way, every cassette is secured in the magazine.

FIG. 13 shows the individual phases during removal of a cassette K from the magazine stand with the aid of a gripping tool 214. In diagram a), it is assumed that an individual cassette K is held in a stand shown only schematically, by an annular rib 5 with a web 105, the said cassette being supported with its peripheral flange 7 against the underneath of the annular rib 5 and on the upper surface of the snap-in web end 94 (FIG. 14) and being secured against slipping by means of the fixing pins 5*a*. The annular rib 5 and web 105 can be relatively short, as shown in FIG. 14.

If the gripping tool 214 travels toward the magazine, for example along a rail corresponding to the rail 86 (FIG. 12), its fork arms grip the peripheral wall of the cassette K. An eccentric roll Ex mounted on the gripping tool 214 assumes the position indicated by a dashed line in FIG. 14.

As soon as the gripping tool 214 has reached its final position, shown in FIG. 13*b*), the eccentric roll Ex is moved from the position indicated by a dashed line in FIG. 14, with the aid of a drive dr, to the position indicated by solid lines, in which its axle ax engages the fork of the locking sheet 92. The drive dr may be either a solenoid or a fluidic cylinder. Because it is engaged by the eccentric roll Ex, the cassette K is secured on the gripping tool and prevented from falling off. It is therefore advantageous if the right-hand end (based on FIG. 14) of axle ax is secured against axial displacement, in a manner not shown. In this case, the drive unit dr expediently engages not only a bearing, which is designated be, of the axle ax, but also its right-hand end provided with an axial bearing (not shown).

The toothed segment 94*a* which engages a pinion 95 of a motor 96 when the axle ax moves from the position indicated by a dashed line to the position indicated by solid lines is attached to the axle ax. The toothed segment 94*a* passes through a slot 97 in the gripping tool 214. As soon as the eccentric roll Ex is in the position indicated by solid lines, the motor 96 is supplied with power, for a period sufficient to rotate the eccentric roll Ex through 90 degrees, from the position shown in FIG. 13*b*) to that shown in FIG. 13*c*).

As shown in FIG. 13*c*), the cassette K is raised in such a way that it is disengaged from the pin 5*a*. When the gripping tool 214 moves somewhat to the right (based on FIG. 13), the peripheral flange 7 of the cassette K is supported on the fork arms of the gripping tool 214, in particular on a somewhat raised supporting surface ss, as can be seen particularly clearly in FIG. 13*d*). In this position, however, the cassette K is still somewhat inclined on the gripping tool 214 because the eccentricity of the roll Ex is still directed upward.

Only after a sufficiently extensive withdrawal movement, when it is certain that the cassette K has left the region of the annular rib 5 and its web 105, is the motor 97 switched on, in this case in the opposite direction of rotation; the said motor rotates the eccentric roll Ex to the position shown in FIG. 13*e*), so that the cassette K lies in an approximately horizontal position on the gripping tool 214. The drive unit dr (FIG. 14) can then be actuated again in order to bring the roll Ex from the position indicated by solid lines to the position indicated by dashed lines and thus to permit the cassette K to be placed in the particular position desired.

From the mode of operation, it is clear that actuation of the motor 96 can take place in accordance with a program, and it is therefore advantageous to provide a program control system for this purpose. This also applies to the movement sequences of the take-off means 3 described with reference to FIGS. 9, 9*a*. Since the processing unit PU (FIG. 10) expediently controls at least addressing of the gripper movements, as described above, and, for this purpose, is constantly connected to its control box 119, it would also be possible to use the processing unit PU as a program control system for controlling the motor 96. In contrast, a separate program control system is expediently provided for each take-off means 3, of which, according to FIG. 10, several are in operation, the said program control system being combined, for example, with the punch press control.

While FIG. 14 shows a hole 93 in which a projection 5*a* of the magazine engages, it is of course also possible to secure the cassette K by the reverse measure, where a projection of the cassette K is arranged underneath the flange 7 or between both flanges 7, a counter-projection of the magazine engaging behind the said cassette projection. This is particularly advantageous when the center of gravity line 80' (cf. FIG. 12) is located not outside but inside the magazine, so that furthermore the coils can be stored straight instead of slightly inclined.

In this latter case, however, it is not sufficient to raise one end of the coil by means of the eccentric Ex; instead, in this case, after gripping the cassette K, the entire gripper will have to be lifted together with it in order to detach the engaged cassette and magazine projections and to withdraw the coil from the magazine, in a slightly raised position. This movement too can be controlled by an appropriate program.

It is of course also possible to provide the gripper 114 with position transducers, in particular at the ends of its gripping claw 114, for example with inductive transducers, in order to control its orientation with respect to the cassette and in particular to initiate or terminate the individual movements (forward movement, lifting movement).

The features described can of course be combined both with one another and with prior art features, and can also be varied to a considerable extent; for example, centering in an apparatus according to FIG. 9 could also be achieved if the entire housing Ca were laterally displaceable over the scanned band width, for example on roller bearing guides running at right angles to the longitudinal axis of the band Ba; however, for the reason mentioned (little effect on band running in the region of the cassette mouth 51), rotational movements about an axle A located in the region of the mouth 51 are preferred. Furthermore, the torsion, means 75, 76 for the band could simply be in the form of stationary guides, although the embodiment described has shown particularly little susceptibility to faults.

We claim:

1. A method for storing coils of wound band-like blank material and for charging a processing machine with them, which comprises a combination of the following steps:

(a) the coils are each stored in a magazine on a respective horizontal underlay with the coil axis at right angles to the underlay, (b) each coil, still in the horizontal position with the coil axis at right angles to the underlay, is brought on its underlay to an unwinding station, and (c) in the unwinding station, the band-like blank material is taken off from the coil while keeping the latter in the horizontal position and is fed to the processing machine after being rotated through 90 degrees.

2. A method as claimed in claim 1, wherein the coil is unwound from its outer circumference in the unwinding station.

3. An installation for storing coils of wound band-like blank material and for charging a processing machine with them, comprising a magazine station in which the coil can be stored in the horizontal position with the coil axis at right angles, and an unwinding station in which a coil support is provided, from which unwinding station the band-like blank material wound on the coil can be fed to a processing station, wherein the coil support is likewise designed for a horizontal position of the coil with the coil axis at right angles, and an essentially level respective underlay is provided for supporting each coil in all stations, on which underlay the coil can be brought from the horizontal position in the magazine station to the horizontal coil support.

4. An installation as claimed in claim 3, wherein a loading station for feeding newly delivered coils is additionally provided, and each coil is assigned to a horizontal support surface in this loading station, and is placed on said support surface in a horizontal position.

5. An installation as claimed in claim 4, wherein the loading station is located within range of the gripping means.

6. An installation as claimed in claim 3, wherein the essentially level underlay forms the bottom wall of a cassette with a cylindrical surface which surrounds the coil and is at right angles to the underlay, the said cassette having at least one gripping zone for a gripping tool, formed by a projection and a depression, which are formed by two peripheral flanges separated from one another and forming the depression in between.

7. An installation as claimed in claim 6, wherein the underlay is in the form of a part which is separable from the other parts of the cassette, and at least one projection directed radially inward and supporting the underlay extends from the cylindrical surface.

8. An installation as claimed in claim 6, wherein the underlay has, in its central region, at least one retaining surface which projects upward in the center of the coil.

9. An installation as claimed in claim 6, wherein the underlay plate is cross-shaped.

10. An installation as claimed in claim 6, wherein said cylindrical surface has an orifice of a width corresponding at least to the width of the band to form a cassette mouth.

11. An installation as claimed in claim 10, wherein at least one guide roller is provided within the region of said orifice.

12. An installation as claimed in claim 10, wherein a band brake is provided within the region of said orifice.

13. An installation as claimed in claim 12, wherein the band brake has braking surfaces which subject the two band surfaces of the band emerging from the cassette to the force of a spring, and at least one of the said braking surfaces is formed on a lever which can be brought to a position in which it is raised from the other braking surface, by means of an unlocking mechanism.

14. An installation as claimed in claim 6, wherein at least one orifice is provided on the outside of the cassette to permit the passage of a securing element.

15. An installation as claimed in claim 14, wherein said orifice is provided on one of said flanges.

16. An installation as claimed in claim 3, wherein a gripping means is provided, by means of which the coil stored horizontally in the magazine station, together with its essentially level underlay, can be gripped in the horizontal position and can be placed on the coil support in this position.

17. An installation as claimed in claim 16, further comprising indexing drive means for an indexed movement of said gripping means.

18. An installation as claimed in claim 17, wherein said indexing drive means are arranged to impart a vertical movement to said gripping means.

19. An installation as claimed in claim 18, further comprising a mast-like guide means for said vertical movement.

20. An installation as claimed in claim 19, wherein said mast-like guide means is rotatable about a vertical axle being eccentrically arranged relatively to it.

21. An installation as claimed in claim 16, further comprising a vertical axle arrangement, said gripping means being rotatably supported about said axle arrangement.

22. An installation as claimed in claim 16, wherein a horizontal guide which is rotatable about a vertical axle is provided for the gripping means.

23. An installation as claimed in 16, wherein a horizontal guide is provided for displacement of a vertical guide.

24. An installation as claimed in claim 16, wherein the gripping means has a gripping tool which is generally fork-shaped, for holding the underlay at two positions opposite one another.

25. An installation as claimed in claim 24, wherein said gripping tool is approximately semicircular.

26. An installation as claimed in claim 3, wherein the magazine station has at least one stand with horizontally extending retaining projections arranged one on top of the other.

27. An installation as claimed in claim 26, wherein the stand has a closed vertical wall which encloses the held coils as far as the region of their central plane and is polygonal and has lateral surfaces which are at least approximately parallel to one another.

28. An installation as claimed in claim 21, wherein said stand is shaped as half a hexagonal prism.

29. An installation as claimed in claim 26, wherein the retaining projections are each provided with at least one securing projection which extends in the vertical direction for engaging a recess of a holding part which is connected to the essentially level underlay.

30. An installation as claimed in 29, wherein the holding part is formed by a cassette for the coil.

31. An installation as claimed in claim 26, wherein at least one stand extends above another station located underneath the stand.

32. An installation as claimed in claim 31, wherein said other station is an unwinding station.

33. An installation as claimed in claim 26, wherein the stand embraces the particular coil by less than 180°, the central plane passing through the coils outside the stand.

34. An installation as claimed in claim 3, wherein at least one of said loading station and unwinding station has a vertical axle of rotation which possesses, on its upper end, a turntable with a horizontal support surface for the coil.

35. An installation as claimed in claim 34, wherein the coil support comprises an inner support surface and an annular outer support surface surrounding the same, the inner support surface being at a higher level than the outer support surface, at least partially, and at least during one phase of operation of the installation.

36. An installation as claimed in claim 35, wherein said inner support surface forms the turntable.

37. An installation as claimed in claim 34, wherein the turntable possesses, on an inside portion thereof, a braking surface which is opposite to at least one braking element.

38. An installation as claimed in claim 37, wherein an adjusting arrangement is provided for the braking element.

39. An installation as claimed in claim 38, wherein said adjusting arrangement is for vertical adjustment.

40. An installation as claimed in claim 38, wherein said adjusting arrangement is for radial adjustment.

41. An installation as claimed in claim 34, wherein at least part of the inner support surface can be raised with the aid of a drive, and this part of the inner support surface is formed by two pairs of arms which successively point in opposite directions, are parallel to one another and lie a distance apart to permit the passage of a beam of the underlay.

42. An installation as claimed in claim 41, wherein said drive is a fluidic drive.

43. An installation as claimed in claim 34, wherein a weighing cell is provided on a surface which is subjected to the weight of the coil.

44. An installation as claimed in claim 43, wherein said surface is the support surface for the coil.

45. An installation as claimed in claim 3, wherein the unwinding station is provided with a take-off means for the projecting band end of the coil for transfer to take-off rolls of the processing station, and this take-off means has a stepped drive for the band.

46. An installation as claimed in claim 45, wherein at least one clamping means is provided for clamping the band during stepwise movement thereof.

47. An installation as claimed in claim 45, wherein the stepped drive comprises at least one trolley, which is arranged to be driven by means of a linear drive along a guide path, and further comprises a slide.

48. An installation as claimed in claim 46, wherein at least one said clamping means is provided with cutting means arranged for cutting the band.

49. An installation as claimed in claim 45, wherein a deflecting means for centering the band on the take-off roll is provided.

50. An installation as claimed in claim 49, further comprising a sensing means for sensing the band width and a control element controlled by said sensing means.

51. An installation as claimed in claim 50, wherein said control element comprises an intermediate follow-up control circuit.

52. An installation as claimed in claim 46, wherein one said clamping means comprises a rotary drive for rotating the band through 90°.

53. An installation as claimed in claim 52, wherein said clamping means is arranged on a slide.

54. An installation as claimed in claim 47, wherein the stepped drive comprises at least two slides arranged one beneath the other.

55. An installation as claimed in claim 54, wherein one of said slides comprises a torsion means for twisting the band.

56. An installation as claimed in claim 16, which has a process control system comprising a processing unit, at least one memory, output means, at least one manually operated input means, and at least one automatic data acquisition unit, for controlling the movement of at least a gripping means.

57. An installation as claimed in claim 56, wherein the automatic data acquisition unit comprises an advance measuring means for the band.

58. An installation as claimed in claim 56, wherein a processing unit is provided, by means of which the material consumed can be subtracted from the stock, and new acquisition can be added.

59. An installation as claimed in claim 56, wherein a processing unit is provided, by means of which orders to be delivered in installments can be stored, and production batches for partial deliveries can be subtracted from these orders.

60. An installation as claimed in claim 56, wherein a memory is provided, in which the properties such as type of material, width, etc. of coils and their location in the magazine can be stored in associated memory locations.

61. An installation as claimed in claim 56, wherein the automatic data acquisition unit comprises a weighing means for the coil.

62. An installation for storing coils of wound band-like blank material and for charging a processing machine with them, comprising:

(a) a magazine station which is operable for receiving and storing a coil horizontally:

(b) an unwinding station in which a coil support is provided, which unwinding station is located such that the band-like blank material wound on the coil can be fed to a processing station;

wherein the coil support likewise is operable for receiving the coil in a horizontal position, with the coil axis at right angles to the coil support;

(c) a respective substantially flat underlay for supporting each coil in all stations, and for transferring the coil from its horizontal in the magazine station to the horizontal coil support;

wherein the underlay forms the bottom wall of a cassette with a surface which surrounds the coil and is at right angles to the underlay, said cassette having on said surrounding surface at least one gripping zone means for receiving and being gripping by a gripping tool;

(d) gripping means for gripping and holding, in a horizontal position, the coil stored horizontally in the magazine station, together with its underlay, and placing said coil and underlay on the coil support in this position;

(e) drive means for an indexed vertical movement and a rotational movement of said gripping means;

(f) at least on stand in the magazine station with a plurality of horizontally oriented underlay retaining means arranged one on top of the other;

wherein the stand has a substantially closed vertical wall which is configured to enclose the coils held therein at least as far as the region of their central axis; and (g) a loading station for receiving newly delivered coils, each coil being received on a horizontally support surface in this loading station, and being placed on said support surface in a horizontal position;

wherein the loading station is located within range of said gripping means, whereby said gripping means is operable for transferring said coil from said loading station to said magazine station for storing said coil.

* * * * *